US012589899B2

(12) United States Patent
Cassoli et al.

(10) Patent No.: US 12,589,899 B2
(45) Date of Patent: Mar. 31, 2026

(54) MECHATRONIC AND MODULAR ENCAPSULATING MACHINE FOR FOOD OR BEVERAGE CONTAINERS

(71) Applicant: Ecocap's S.r.l., Casalecchio di Reno (IT)

(72) Inventors: Marco Cassoli, Casalecchio di Reno (IT); Jacopo Cassoli, Casalecchio di Reno (IT); Nicola Giuliani, Valsamoggia (IT)

( * ) Notice: Subject to any disclaimer, the term of this patent is extended or adjusted under 35 U.S.C. 154(b) by 0 days.

(21) Appl. No.: 18/699,226

(22) PCT Filed: Oct. 8, 2022

(86) PCT No.: PCT/IB2022/059643
§ 371 (c)(1),
(2) Date: Apr. 5, 2024

(87) PCT Pub. No.: WO2023/057991
PCT Pub. Date: Apr. 13, 2023

(65) Prior Publication Data

US 2025/0236421 A1 Jul. 24, 2025

(30) Foreign Application Priority Data

Oct. 8, 2021 (IT) ..... 102021000025859
Oct. 8, 2021 (IT) ..... 102021000025871

(51) Int. Cl.
*B65B 7/28* (2006.01)
*B65B 29/02* (2006.01)

(52) U.S. Cl.
CPC ..... *B65B 7/2807* (2013.01); *B65B 7/2878* (2013.01); *B65B 29/022* (2017.08)

(58) Field of Classification Search
CPC ..... B65B 7/2878; B65B 7/2807; B65B 7/01; B65B 7/28; B65B 7/285; B65B 41/06; B65B 17/025; B65B 43/50; B65B 51/14; B29C 65/7885; B29C 66/53461; B65D 2517/0098; B65D 51/185; B67B 5/03
(Continued)

(56) References Cited

U.S. PATENT DOCUMENTS 1,629,599 A * 5/1927 Tevander ..... B67B 5/06 53/137.1
4,104,845 A * 8/1978 Hoffmann ..... B67B 5/032 53/49

(Continued)

*Primary Examiner* — Dariush Seif
(74) *Attorney, Agent, or Firm* — Themis Law

(57) ABSTRACT

A machine assembly for applying a heat-sealable capsule to a beverage container includes a main drum with sealing heads and bases movable vertically by a first cam to bring each container to a raised position for sealing the capsule thereon; and a pick-up assembly with a slide and a capsule pick-up and release element. The slide moves the pick-up and release element upwardly and downwardly with a horizontal slide guided by a second cam to cause the pick-up and release element to run along the same trajectory as a pick-up member carried by a sealing head, and a vertical slide guided by a third cam causes the pick-up and release element to be vertically proximal to the gripping member and release the capsule to the sealing head. The pick-up and release element can then move radially away from the gripping member after releasing the capsule.

8 Claims, 9 Drawing Sheets

(58) Field of Classification Search
USPC ..... 53/478
See application file for complete search history.

(56) References Cited

U.S. PATENT DOCUMENTS 4,230,518 A * 10/1980 Fahnrich ..... B65C 3/22 156/487
4,362,002 A * 12/1982 Rowland ..... B65B 7/164 53/488
4,412,797 A * 11/1983 Murayama ..... B29C 48/10 425/114
4,414,056 A * 11/1983 Buchholz ..... B65C 3/20 156/476
4,437,289 A * 3/1984 Bedin ..... B67B 3/062 53/64
4,613,397 A * 9/1986 Buchholz ..... B65C 3/22 156/476
4,719,739 A * 1/1988 Foldesi ..... B29C 65/80 53/298
4,816,110 A * 3/1989 Foldesi ..... B65B 7/2807 53/DIG. 2
4,927,048 A * 5/1990 Howard ..... B65D 41/52 220/279
5,346,088 A * 9/1994 Brimo, II ..... B65D 51/20 220/729
6,104,013 A * 8/2000 Miller ..... B29C 65/787 156/274.2
6,328,832 B1 * 12/2001 Otruba ..... B65C 9/44 156/215
6,336,309 B1 * 1/2002 Groppi ..... B65D 71/508 53/484
6,508,047 B1 * 1/2003 Groppi ..... B65B 17/025 294/87.2
6,708,748 B1 * 3/2004 Kronseder ..... B67B 5/03 53/129.1
7,168,223 B2 1/2007 Caffeo
10,472,105 B2 * 11/2019 Castellari ..... B65B 29/022
11,440,687 B2 * 9/2022 Furlotti ..... B29C 66/81427
12,145,762 B2 * 11/2024 Cassoli ..... B65B 7/2807
12,202,639 B2 * 1/2025 Komatsu ..... B29C 65/80
2005/0160698 A1 * 7/2005 Caffeo ..... B65B 7/2878 53/290
2016/0009427 A1 * 1/2016 Rea ..... B65B 35/18 53/282
2019/0112090 A1 * 4/2019 Vetten ..... B65B 61/24
2021/0371140 A1 * 12/2021 Price ..... B65B 7/28
2023/0234738 A1 * 7/2023 Biondi ..... B65B 29/022
2023/0271733 A1 * 8/2023 Biondi ..... B65B 7/01 53/296
2023/0271734 A1 * 8/2023 Negrini ..... B65B 29/022 53/478

* cited by examiner

MECHATRONIC AND MODULAR ENCAPSULATING MACHINE FOR FOOD OR BEVERAGE CONTAINERS

TECHNICAL FIELD

The present invention relates to an automatic, mechatronic, and modular machine for applying by heat sealing a capsule to containers in automation lines in the beverage industry.

More specifically, the present invention relates to an automatic, mechatronic and modular machine for applying by means of heat-sealing of a sterile aluminium capsule, to containers of preferably cylindrical, but also square, rectangular or oval shape, for food or beverages defined as "cans" or "jars".

More specifically, the present invention relates to a high productivity machine which performs the heat sealing of a capsule of aluminium mono-material "coupled" with lacquer to the existing lid of the can, and is characterised by innovative solutions related to the capsule transfer mechanism, the modular architecture of the machine, the handling of the capsules, and the electronic control of the electrical axes of the machine.

BACKGROUND ART

Nowadays, on the world market, there are many types of machines and equipment that perform such operations, related to the encapsulating speed and especially to the nature of the capsule used.

SUMMARY OF THE INVENTION

The purpose of the present invention is to overcome the drawbacks of the background art by providing an improved automatic, mechatronic and modular machine with significant benefits in terms of production speed, ease of assembly and layout, with particular reference to the scale economies achievable by producing a reduced number of modules which can be assembled in different orientations and, therefore, adapt more closely to the layout of the production line and the plant in which the production line is set up. This is achieved in a machine assembly for applying a heat-sealable capsule to a container of a beverage comprising a main drum with a first plurality of sealing heads and corresponding second plurality of vertically movable handling bases by means of a first cam concentric with the drum to bring each container, during rotation of the drum, from a lowered position of picking up the container to a raised position of sealing the capsule to the container by means of the corresponding sealing head; and a pick-up assembly having at least one slide rotatably carried by a motor and a capsule pick-up and release member carried by the slide, the slide being configured to move in a vertical and horizontal direction the capsule pick-up and release member by means of a horizontal slide guided by a second cam defining at least one section in which the capsule pick-up and release member traverses the same arc trajectory as a gripping member of the capsule carried by the corresponding sealing head, and by a vertical slide guided by a third cam defining a raised section in which the pick-up and release member is vertically proximal to the gripping member and in use releases the capsule to the sealing head, and a lowered section in which in use, the pick-up and release member moves radially away from the gripping member after releasing the capsule.

According to the above, the sealing head has a gripping member having a substantially fixed vertical position, which simplifies the construction of the main drum. In addition, the arrangement of a cam for vertical movement from the bottom to the top of the pick-up member and release of the pick-up assembly allows the modularity of the machine assembly to be increased: it is possible, for example, to manufacture a single drum and combine several pick-up assemblies according to requirements, see for example FIG. 2 showing the central drum module of the machine assembly with a central drum and four capsule pick-up assemblies. For a further increase in modularity, the structural support, to which the above-mentioned pick-up assemblies are to be fixed, can be made symmetrically so that left-handed and/or right-handed machines can be realised depending on the configuration of the production line.

BRIEF DESCRIPTION OF THE DRAWINGS

The invention will now be described with reference to one or more non-limiting embodiments illustrated in the appended figures, wherein.

DETAILED DESCRIPTION OF THE INVENTION

Figure 1:
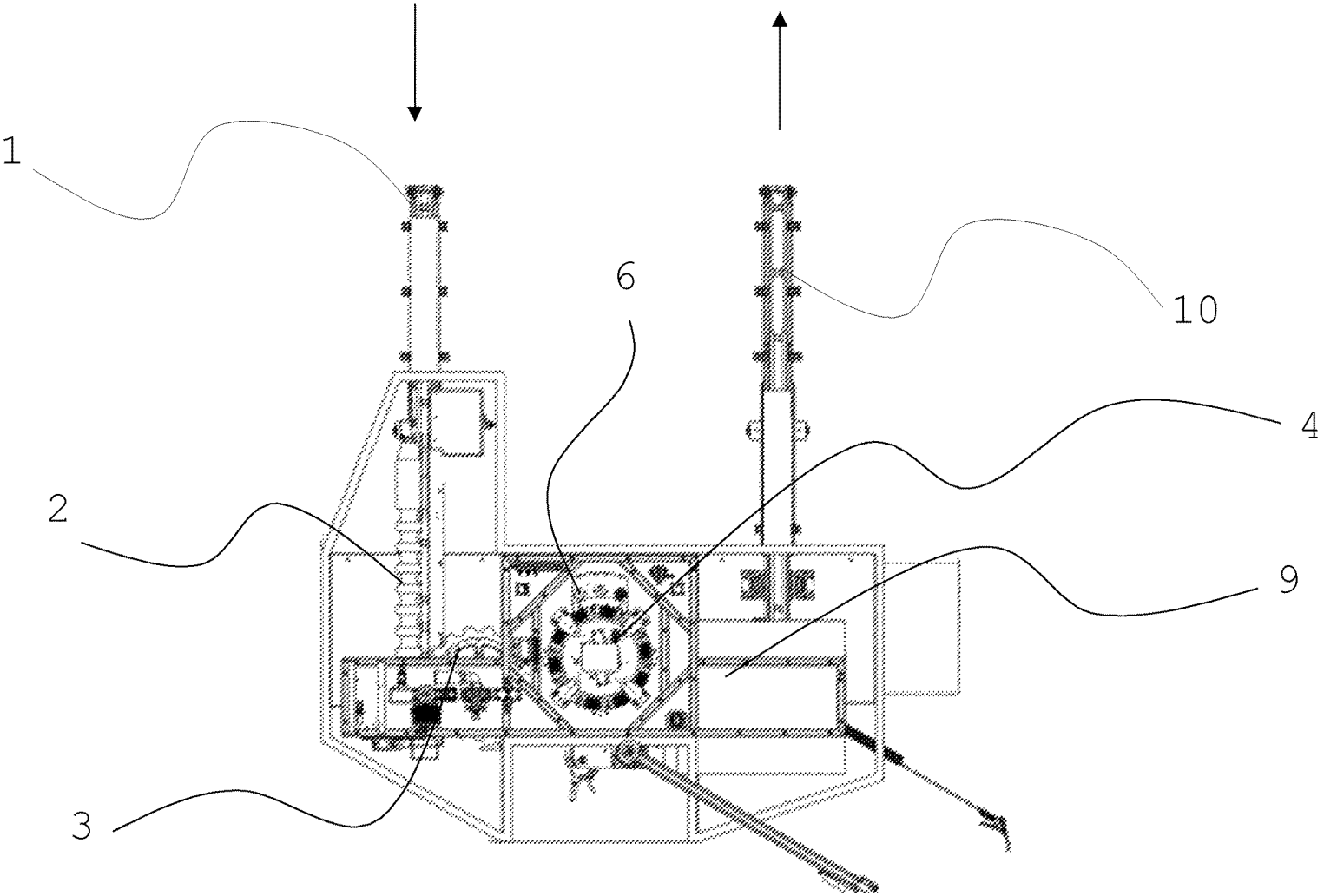
FIG. 1: is a plan view of a specific "layout" of a machine according to the present invention.

With reference to FIG. 1, by 1 is indicated a can conveyor, which by means of an auger conveyor 2, spaces and conveys cans to a first drum 3 having a circumferential arc trajectory to a main drum 4, where the sealing of the capsules takes place in order to form a protective capsule on the can lids.

The capsules are contained in stacks in vertical storage 5. Through a pick-up assembly 6, one set of suction cups picks up the capsules from the storage and passes them to another set of suction cups located inside sealing heads 7 carried by the main drum 4.

In the main drum 4, the cans received from the first drum 3 are lifted by lifting assemblies S (FIG. 3, in which a single can lifting drive is shown for illustrative clarity) and come into contact first with the capsules and then with the sealing heads 7, which perform the heating and deformation of the capsules to create a protective capsule on the head of the corresponding can.

At the end of the heat-sealing cycle, the cans are transferred onto a third drum 9 and conveyed to the outlet conveyor 10.

Figure 2:
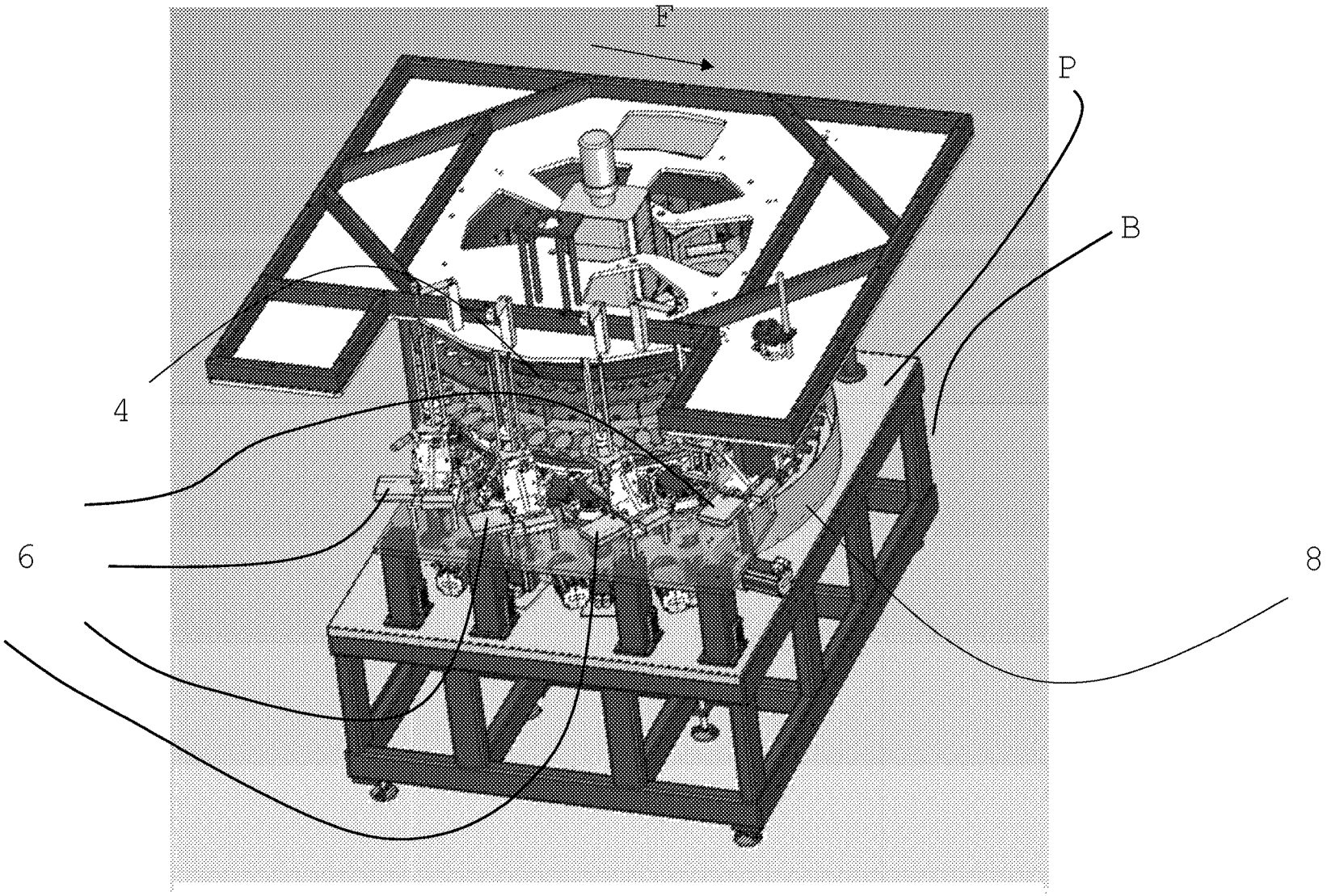
FIG. 2: is a perspective view of a main drum of the machine of FIG. 1, in the configuration with four modular pick-up assemblies.

FIG. 2 shows in more detail the main drum 4 equipped with four pick-up assembly 6, an optional configuration when e.g. the main drum 4 has a relatively large diameter and there are numerous, e.g. 60 heads 7 with a diameter of the main drum 4 of 1800 mm. As illustrated in FIG. 2, the main drum 4 is mounted on a base B, which also serves as a support for the pick-up assembly 6. Considering arrow F as representing the rotation of the main drum 4, the cans are received by the sealing heads 7 from the left.

Figure 7:
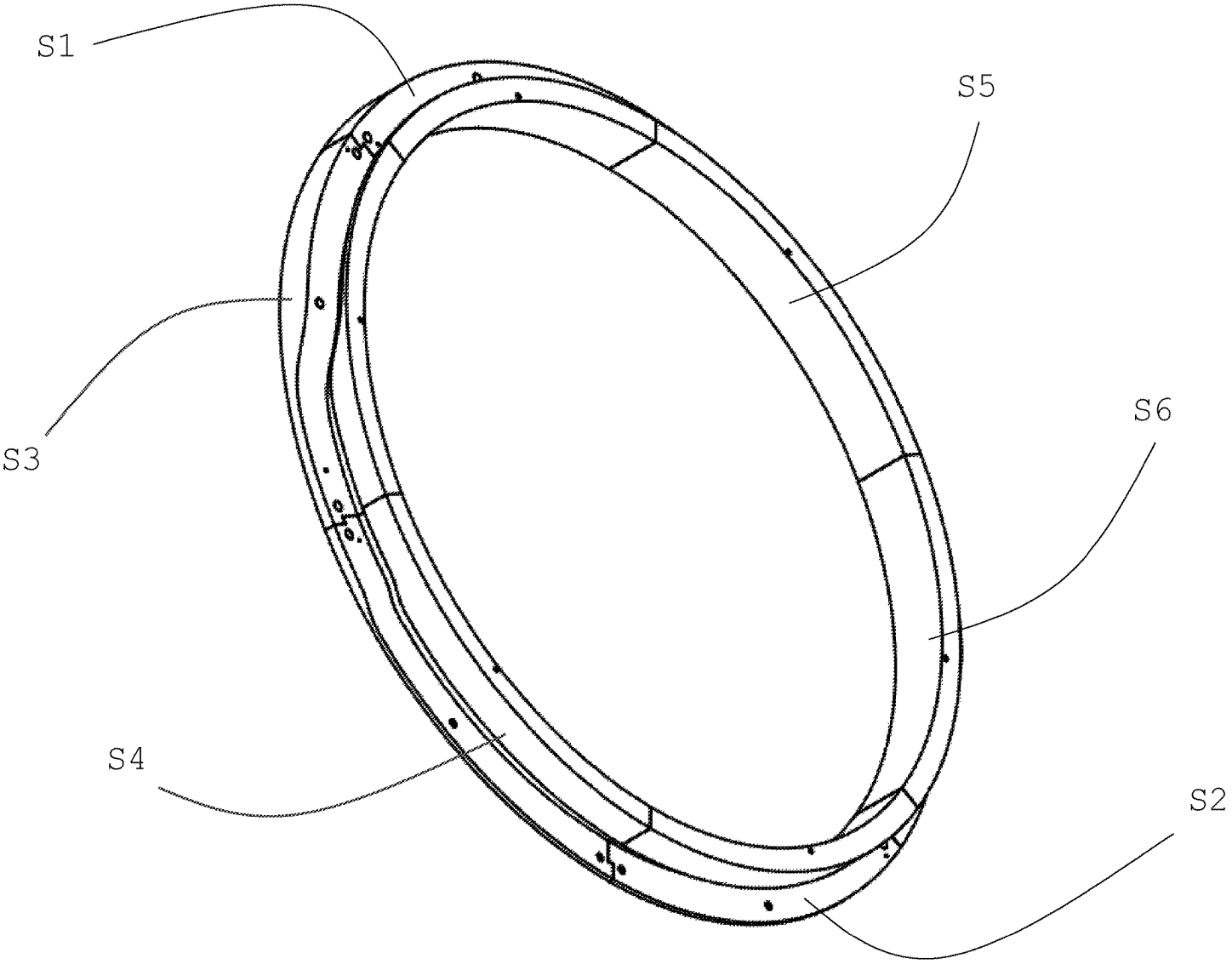
FIG. 7: is a detailed perspective view of the cam profile relating to the capsule pick-up and transfer assembly illustrated in FIG. 5.

In more detail, the main drum 4 is driven into rotation by a motor M (not illustrated) and the movement towards the sealing heads 7 is performed by means of a cam profile concentric to the drum and arranged inferiorly to the sealing heads 7. For each sealing head 7, a base BS belonging to the lifting assembly S and movable vertically along special sleeves M carried by the main drum, comprises a cam follower or tappet P guided by the cam profile (described further below) to provide angular synchronisation between a lowered position of the base when the can is released from the first drum 3, a lifting angular sector towards the sealing head 7, a sealing angular sector in which the can has a substantially constant vertical height, a releasing angular sector of the can at the outlet conveyor 10 and a descending angular sector in which the base returns to the lowered position. An example of a cam profile for moving the movable base is illustrated in FIG. 7. According to the present invention, the sealing heads 7 are not directly actuated for the purpose of adjusting the vertical position, which, as a whole, remains fixed. It should be noted that, when the cans rise, in contact with the capsules held by the sealing heads, they press the capsules and compress springs which exert a pushing force necessary to sealing the capsule.

Figure 3:
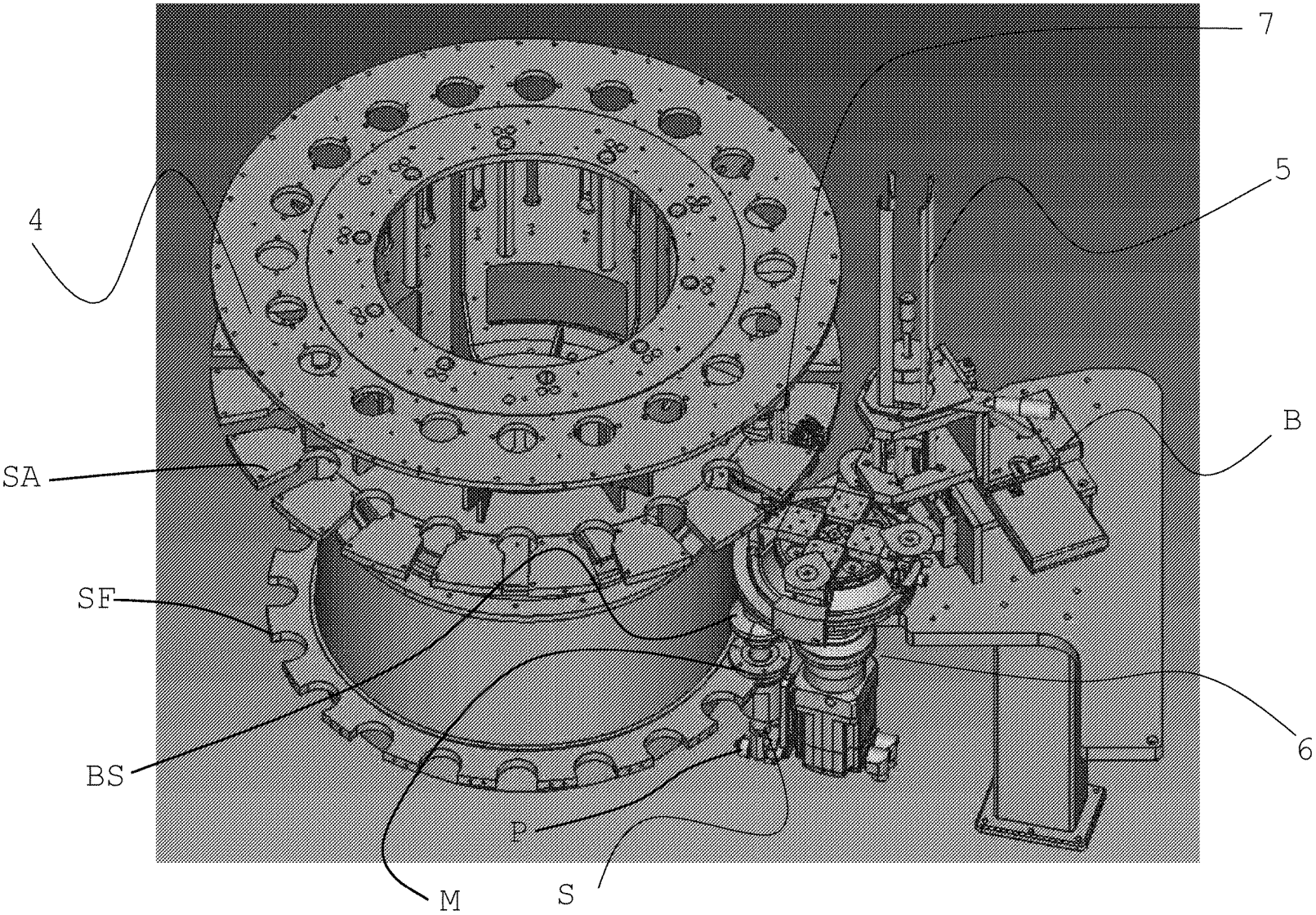
FIG. 3: is a perspective view with details removed for clarity of some modular assemblies of the machine of FIG. 1, with particular attention to the seats of the circular structure of the main drum housing the can bodies, to the pick-up assembly, to the lifting drive by means of a cam of the cans from the bottom to the top, to the vertical storage of the capsules.

Illustrated in FIG. 3, with numerous components removed for clarity, is an interface area between the main drum 4 and a pick-up assembly 6, with the corresponding plurality of pre-stacked capsules stacked in the vertical storage 5, which are held in place by a series of nails 8 that prevent them from falling out by gravity. Preferably, the storage 5 is a module fixed and rigid to the base B in a position adjacent to that of the pick-up assembly 6, so that the latter can pick up the capsules in use.

In the open housings SA, the can e.g. is introduced by tangency of the trajectories e.g. of the can axis between the first drum 3 and the main drum 4. Guide elements are known and not further described to facilitate the receipt of the cans in the open housings SA; in each of the bottom housings SF, the corresponding pick-up assembly S is fixed.

Figure 4:
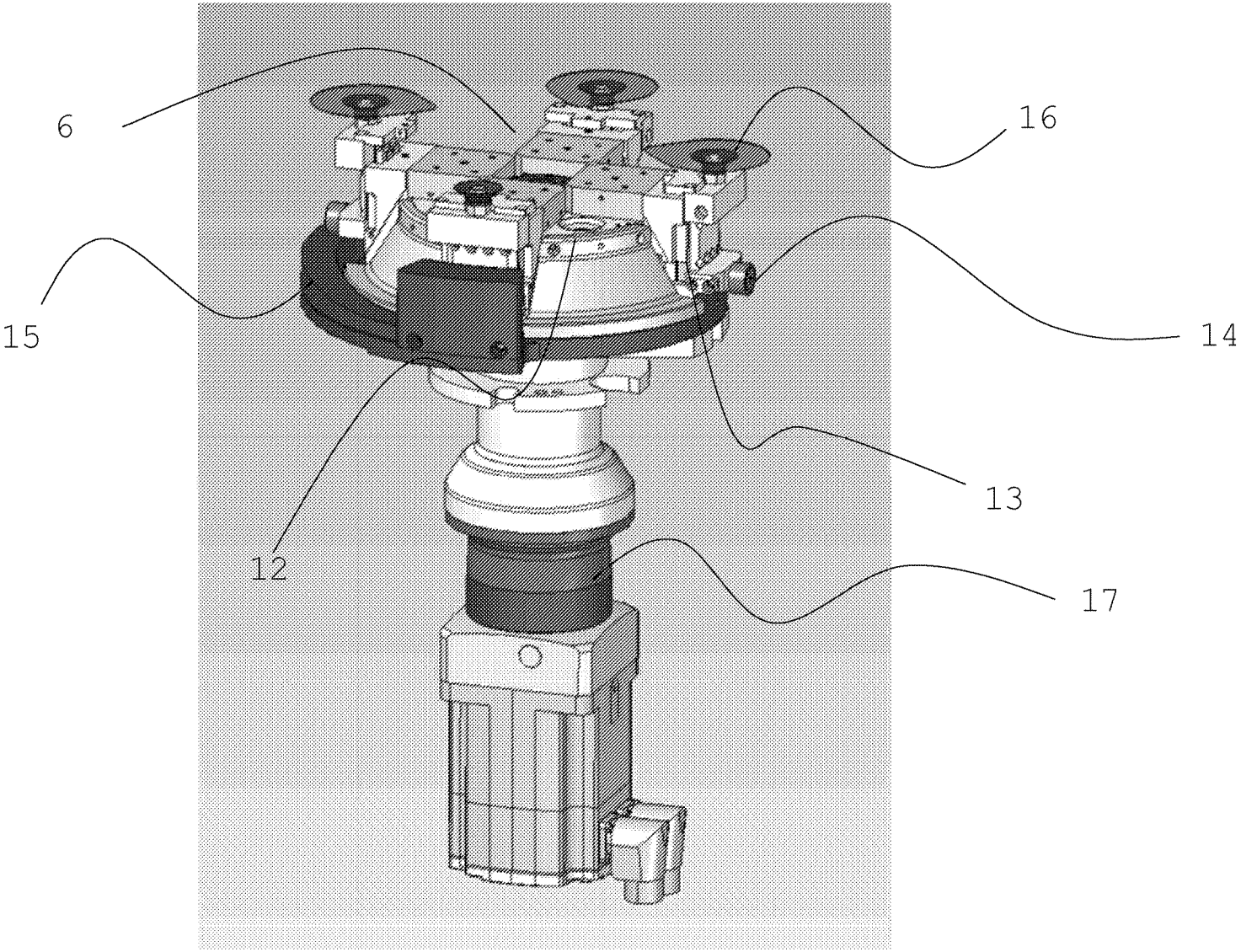
FIG. 4: is a detailed view of the pick-up assembly with component reference letters, illustrated in its general operation in the previous figure.

In FIG. 4, there is illustrated a cruciform pick-up assembly 6 comprising a main disc 12 on which are mounted dual-axis movable slides 13 configured to move in the horizontal and vertical directions elements for gripping the cans taken from the storage 5.

Figure 5:
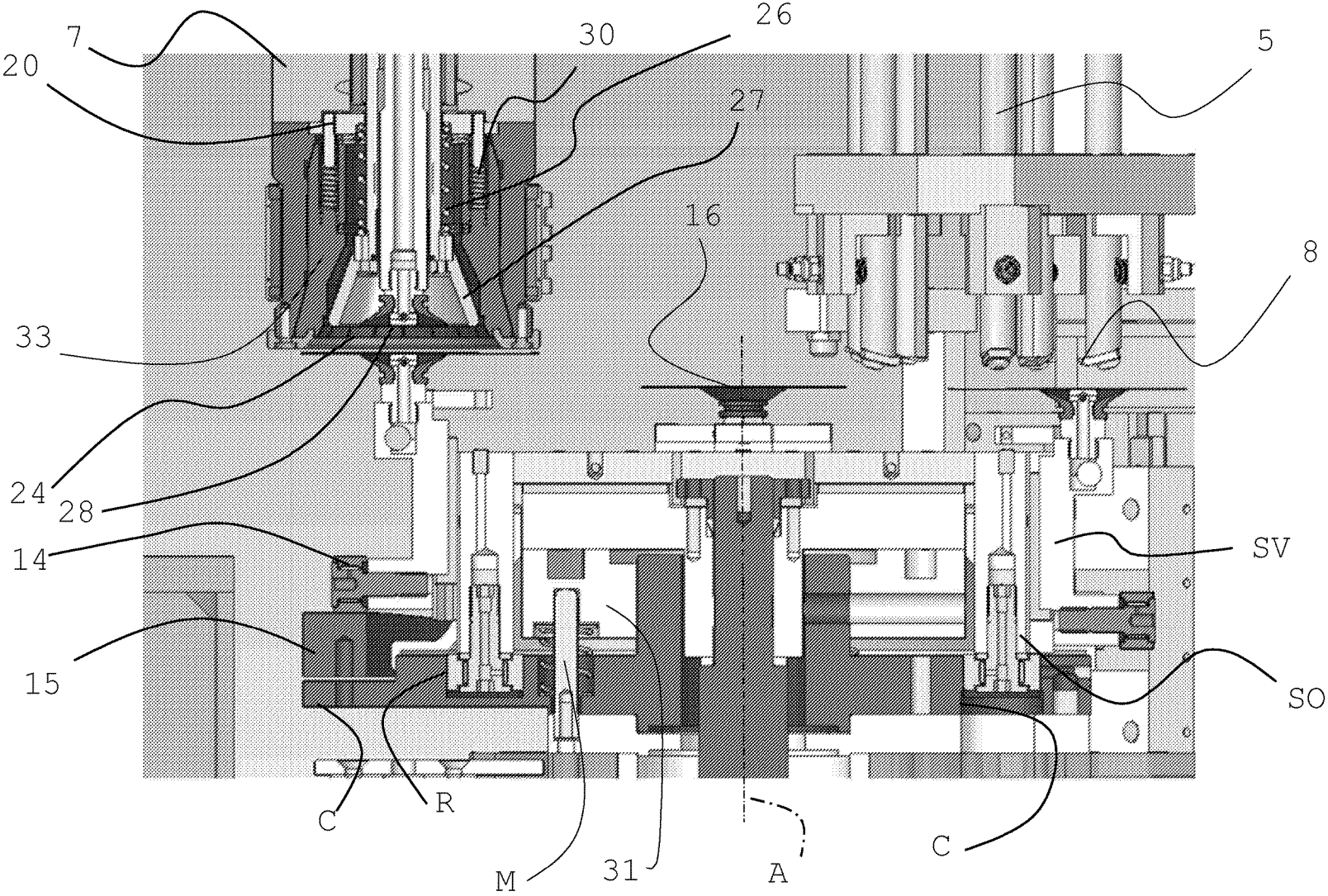
FIG. 5: is a longitudinal cross-sectional view of a modular assembly for the pick-up and transfer of sealable capsules on cans and the structure of the can heat-sealing assembly housed on the main drum.

The movable slides 13 are rotated about an axis and, during handling, are guided in both vertical and horizontal directions by corresponding rollers 14 and R, which act as cam followers or tappets of as many suitably shaped cam profiles 15 and C. In particular, the cam profile 15 has a face in contact with the rollers 14, e.g. cylindrical rollers, having a local normal direction arranged towards the sealing head 7, e.g. in a vertical direction; the cam profile C has a face in contact with the rollers C, e.g. cylindrical rollers, having a local normal direction transverse to that of the cam 15, e.g. substantially horizontal. Furthermore, in order to achieve a coordinated movement of the flat capsule in radial and horizontal direction, the cam 15 follows in offset the radial shape of the cam C. Preferably, the movable slides 13 comprise a horizontally movable slide SO on which a further vertically movable slide SV is mounted: the slide SO is guided by the roller R and the slide SV is guided by the roller 14. Furthermore, as illustrated in FIG. 5, preferably the roller R is projecting from the opposite side of the slide SV to the slide SO and the roller 14 is projecting from the slide SV. Furthermore, the pick-up assembly 6 comprises an angularly fixed crown C to which the cam profiles 15 and C are releasably fixed, e.g. as inserts.

The movable slides 13, e.g. angularly equally spaced, comprise corresponding suction cups 16 which are an example of a capsule gripping member. The disc 12 is driven into rotation by a brushless gear motor 17.

During the rotation of the disc 12, the rollers of the movable slides 13 follow the cams 15 and C and lead the suction cups 16 to pick up a capsule from the storage 5 and deliver it to a corresponding sealing head 7.

Thus, a pick-up from the storage 5 and transfer to the capsule head 7 of the capsules takes place from the bottom of the vertical capsule holder storage, thus making the movement of the capsules in the vertical direction performed by the pick-up assembly 6 also being released to the sealing head 7.

Figure 9:
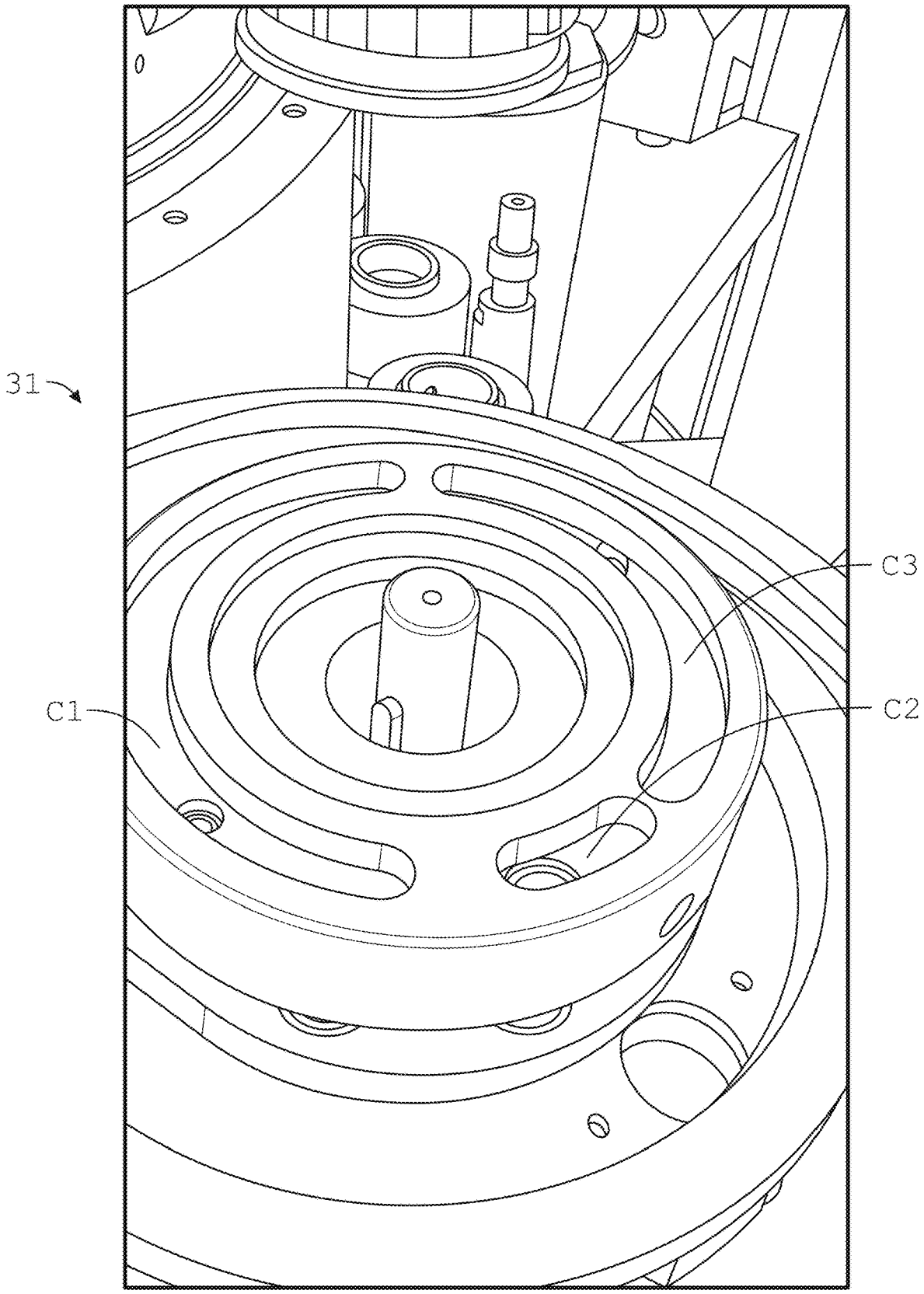
FIG. 9: is a perspective view of the channel cam for creating a vacuum during the pick-up and transfer of the cans.

The suction cups 16 are connected to a vacuum system (not shown) via a channel cam 31 (shown in FIG. 9). The channel cam 31 is shaped on its upper surface in such a way as to have circumferential slits defining 3 chambers, denoted C1, C2 and C3. The vacuum is handled in a similar manner with both the double-axis pick-up slides (FIG. 9) of the capsules and the main drum 4, i.e. in the heads 7. The channel cam 31 is assembled coaxially to a pivot axis A of the crosshead 6 and held in an angularly fixed position by the spring-loaded retaining system M, which prevents it from being dragged along with the crosshead. A lid integral with the spider is mounted on the channel cam 31, which has a conformation of its lower surface such as to couple with the upper surface of said channel cam 31, so as to open and close the sectors C1, C2 and C3 in a synchronised manner during the movement of the machine and consequently apply a depression to the suction cup 17 on the basis of the angular position of the latter by means of the relative rotation between the spider and the channel cam 31. In particular, according to the embodiment in the figures, each sector C1, C2, C3 corresponds to a phase of the movement of the pick-up and transfer assembly 6. The sector C1 corresponds to the phase of picking up the capsule; and the sector C2 corresponds to the phase of tracking and positioning the capsule in correspondence with the axis of the can carried by the main drum 4, and is characterised by the fact that during this phase the suction cup 17 is fluidically connected to a device for generating negative pressure with respect to the ambient pressure, guaranteeing the adhesion of the capsule to the picking up cup. The sector C3 corresponds to the phase in which the suction cup 17 returns to the storage and in which the suction cup 17 is disconnected from the negative pressure generation device. It should be noted that the disc 12 and the cruise are angularly stationary when the capsule is picked up from the storage 5. By means of a dedicated actuator, when the disc 12 is stationary, the slide SV carrying the suction cup 16 is lifted and, in the descent stroke of the slide SV controlled by the actuator, the capsule held by the vacuum is detached from the storage remaining integral with the suction cup. Preferably, the dedicated actuator is a linear actuator with a head shaped, e.g. with a groove open at the side and having a generally horizontal orientation, to receive the roller 14 and control both the upward and the downward movement of the slide SV when the movable slide 13 is stationary with the suction cup 16 arranged under the storage 5.

After picking up the capsule, the disc 12 accelerates angularly and the roller R guides the horizontal position of the slide 13 via the cam C, which has a contoured profile with a first lobe and a second lobe. While reaching the first lobe, the slide 13 accelerating towards the main drum 4; along the first lobe, the slide 13 joins and overlaps the suction cup 16 along a circumferential arc of the trajectory of the corresponding sealing head 7. Along this arc of circumference, the angular velocity of the suction cup 16 is punctually equal to that of the sealing head, e.g. constant.

Since the speed of the sealing head 7 and the capsules in the corresponding main drum 4 and disc 12 is therefore equal, there is no relative movement between suction cup 16 and a fixed suction cup 28 located within each sealing head 7.

In the synchronisation section of the circumferential trajectories of the suction cups 16 and 28, the latter sucks the capsule away from the suction cups of the mobile double-axis slides.

The passage of the capsule from one suction cup to the other is facilitated by the fact that in the copying section the vacuum interrupted at suction cup 16 is replaced by a compressed air blow.

At this point, the suction cup 28, rotating integral with the main drum 4, moves away from the suction cup 16, which, running along the second lobe, heads back towards the storage 5.

In FIG. 5, the sealing head 7 is illustrated in greater detail and comprises a central body 20 heated by one or two resistors controlled by a temperature probe. Optionally, each of the two heating elements has the power required to sealing the capsule, so if one heating element breaks or malfunctions, an electronic system automatically excludes it by triggering the second heating element. This guarantees the continuous operation of the machine.

Inside the central body 20 is a capsule-forming presser 24.

The presser 24, positioned at the bottom and in use facing the can, surrounds a connected conical element 27 pushed down by a spring 26 preferably coaxial to the conical element 27. The sealing head 7 is enclosed by the outer surface 21 provided with one or more heating resistors (not illustrated).

The presser element 24 has a structure of movable sectors 33 carried in a vertical direction by as many springs 30.

The spring 26 is relatively non-rigid and is used for the operation of pre-pressing the aluminium capsule carried by a suction cup 28 of the head 7, i.e. it compresses under the action of the can moved upwards by the cam of FIG. 7 while the main drum 4 rotates. While the can is in such an upward position, the springs 30 perform the operation of crimping the capsule on the edge of the can by applying an action due to its own compression and to the particular conformation of its own end portion in contact with the capsule.

More specifically, when the can rises, moved by the cam of the main drum 4, it encounters the capsule held by the suction cup 28.

Subsequently, the suction cup 16, pushed by the can against the action of the springs 30, also begins to rise, copying the upward movement of the can. The can rises until it meets the movable sectors 33. At this point, the capsule, which is compressed between the can and the forming presser 24, assumes the shape of the lid of the can by adhering to the outer part of the lid itself, compressed against the movable sectors 33 against the action of the springs 30.

The can continues to rise by pushing up the movable sectors 33 until the cam of the main drum 4 has reached the point of maximum rise.

The sectors 30 loaded by the springs 33, see above, and sliding in the main body 20 tighten the capsule against the outer edge of the can.

For the entire duration of the angular sealing sector, the can is then pressed against the capsule and the capsule is pressed against the sectors 33 which, being heated, generate sealing on both the top and side of the can.

Figure 6:
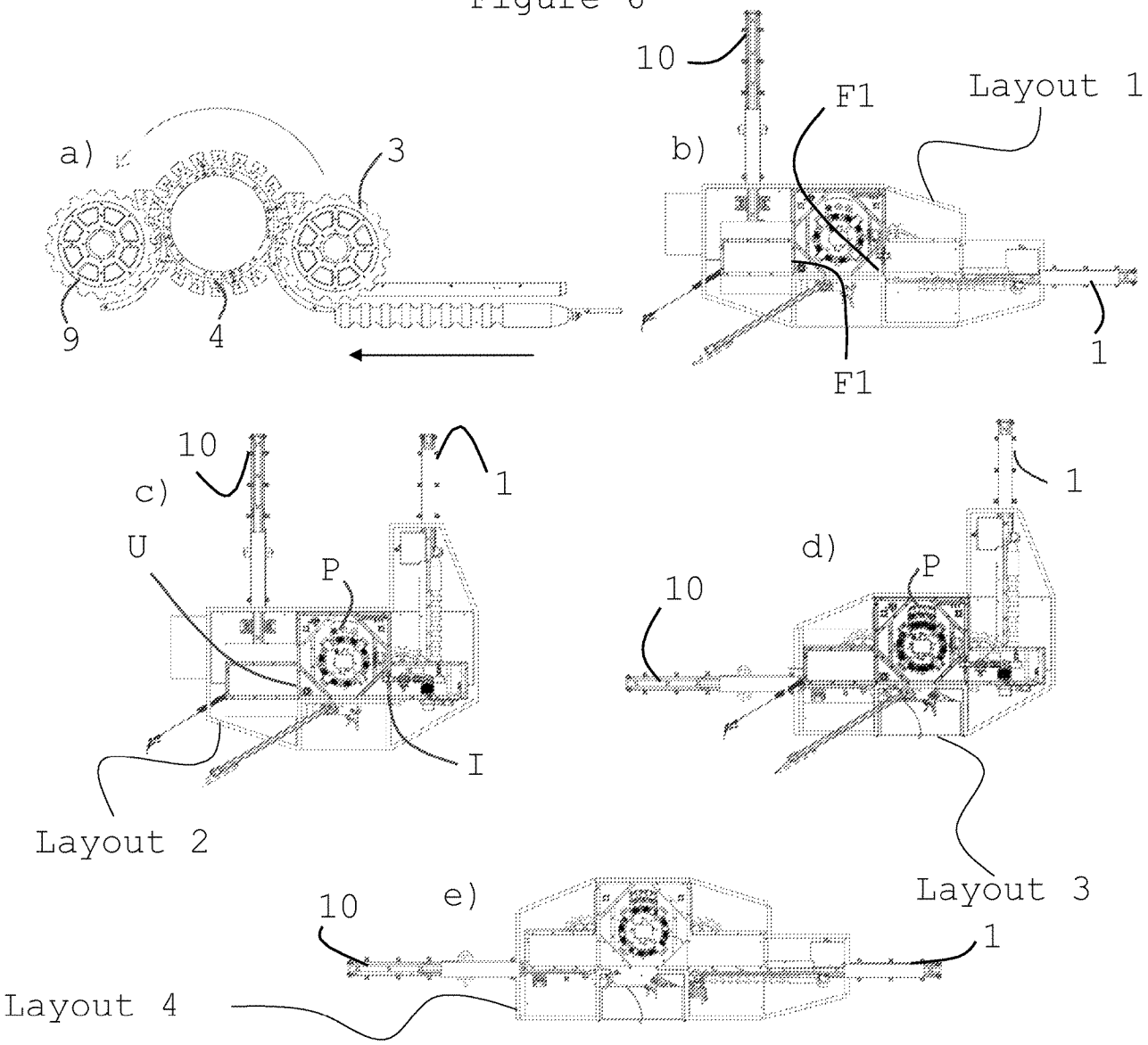
FIG. 6: shows top-down views of possible modular machine "lay-out" configurations, which can be obtained by assembling the various modular assemblies.

FIG. 6 shows different configurations of the machine assembly when the following modules are present: infeed conveyor 1, main drum 4, outlet conveyor 10, pick-up assembly 6 and storage 5.

In particular, the main drum 4 presents the following interface stations: can inlet I, can outlet U and one or more capsule pick-ups P; the inlet conveyor 1 presents the interface station for feeding said can inlet station; the outlet conveyor 10 presents the pick-up interface from said can outlet station.

With reference to the input conveyors 1 and outlet conveyor 10, there are at least two interfaces in which, after a rigid connection with the base B, the corresponding drum 3 and 9 are positioned so that a corresponding trajectory of a can, i.e. under theoretical conditions the trajectories of the geometric centres of the seat releasing the can and the seat receiving it, is substantially tangent to the trajectory of the can on board the main drum 4. The condition of tangency, i.e. tangent in common between the corresponding circumferential arcs at the point where the can passes from one drum to the next, is for example shown in FIG. 6*a*. Furthermore, the rotation axis of the drum s 3, 9, 10 is parallel to that of the main drum 4 and perpendicular to the bisector of an angle between said faces lying in a plane perpendicular to the rotation axes.

FIGS. 6*b*-6*e* illustrate four possible layouts in the non-limiting embodiment in which the at least two faces F1, F2 (the latter illustrated in greater detail in FIG. 8) of the conveyors 1, 10 are arranged at 90° to each other and parallel to the rotation axes of the drum s.

With reference to the pick-up assembly 6, the interface comprises the circumferential arc of the main drum 4 along which the suction cup 16 has a trajectory superimposed on that of the suction cup 28; therefore, the position on the base B of each pick-up assembly is defined by the double-lobe cam C and the position on the base B varies if the rotation of the main drum 4 changes from right to left. The latter preferably has the cam of FIG. 7 made in circumferential sectors and, when the rotation of the main drum 4 is reversed, the circumferential sectors are also disassembled and reassembled in a configuration axisymmetrical to that prior to disassembly. In particular, the cam illustrated in FIG. 7 features a structure of assembled sectors. In particular, sectors S1 and S2, are illustrated, which are always present in the cam and independent of the direction of rotation, left or right. For this purpose, sectors S1 and S2 are essentially straight and flat to define the lowered and raised position of the can respectively. Sectors S3, S4, S5, S6, which represent the profiles for raising and lowering the can by means of lifting assemblies S, are specific for left-hand or right-hand rotation: sectors S1 and S2 can be used in both directions of rotation and the remaining sectors are different and shaped, each, for the specific direction of rotation.

Figure 8:
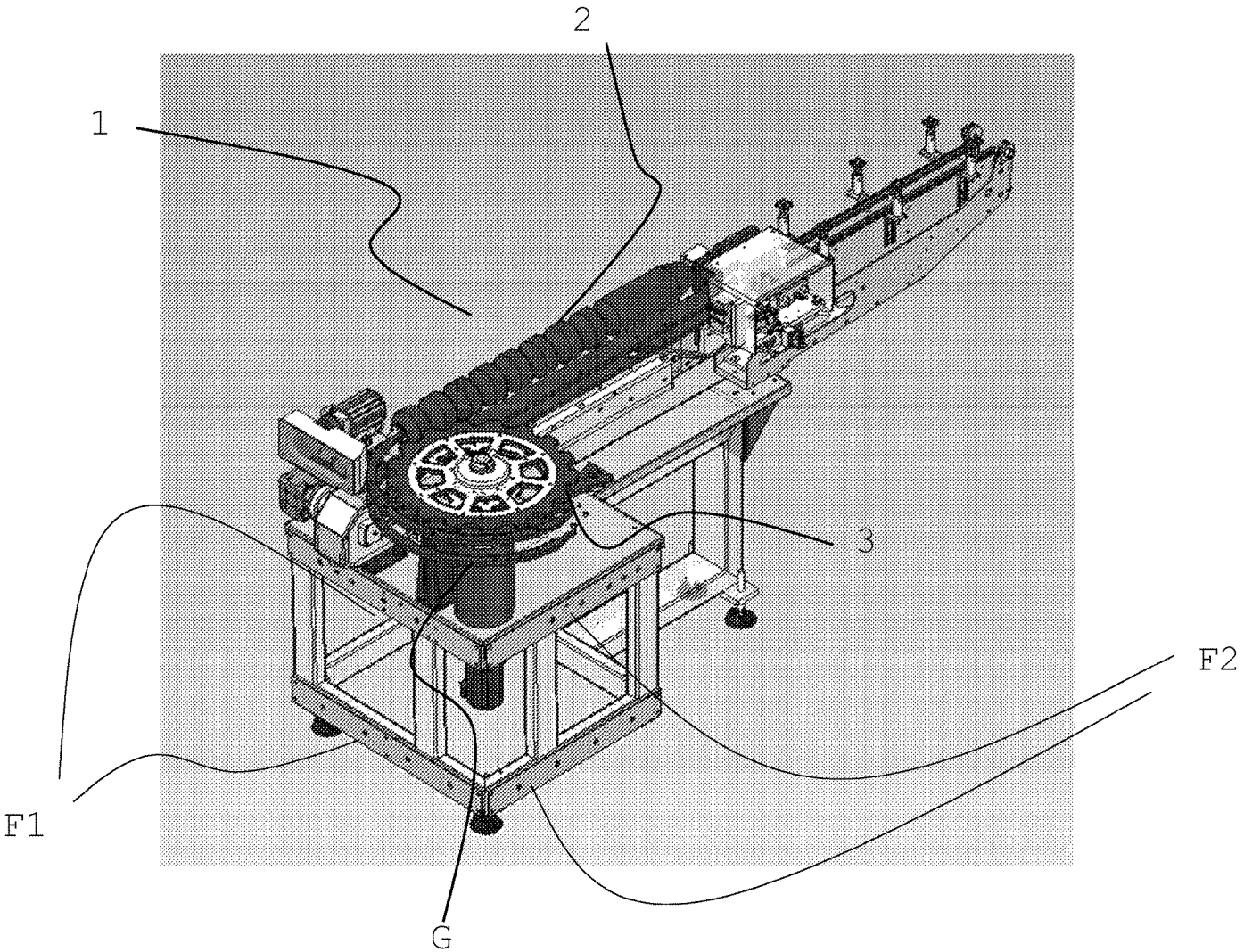
FIG. 8: is a perspective view of the modular can feeding conveyor assembly, with particular reference to the mating faces to a base of the main drum.

FIG. 8 exemplifies the 90° arrangement between the faces F1, F2 of conveyor 1, this feature also being referred to conveyor 10. Depending on the 90° (layout 1, 2, 3) or 180° (layout 4) position, conveyor 1 comprises an arc-shaped guide G having a tangential extension of approximately 90° or approximately 180° (as illustrated in the figure).

According to a preferred embodiment, the electric drive motors of the drums 3, 4, 10, of the screw spacer, and of the disc 12 are servomotors angularly synchronised with each other by means of an automatic control assembly. In particular, since the cans have precise and essentially backlash-free positions in the seats of each drum, the synchronisation of the drum and the auger spacer is limited to the backlash of the can within the corresponding release (e.g. from drum 3) and pick-up (e.g. from main drum 4) seats at the point where the corresponding trajectories are coincident and tangent. It is therefore comparable to that of a gear. On the other hand, the pick-up assembly 6 presents fewer constraints since it relates the suction cups 16 and 28 to each other: the coaxiality condition of the suction cups 16 and 28 in the section between the two lobes of the cam, which is one of several reference positions, can be adjusted to make the suction cup 16 advance or retard with respect to the suction cup 28 if necessary, by means of a suitable user interface through which the advance or retard can be adjusted. This allows particularly precise adjustments to be made while keeping the pick-up assembly 6 mounted on the base B e.g. when a new batch of capsules, which may have slightly different tolerances from the previous batch, is loaded into the storage 5.

In accordance with an embodiment not illustrated, the rotation of the cruciform pick-up assembly is controlled by means of a mechanical intermitter meshing with the main drum 4. In this way, the synchronisation i.e. the repetitive bonding for each cycle of the suction cup 16 controlled by the cams C, 15 with respect to the corresponding suction cups of 28, is completely mechanical. Furthermore, the cams C, 15 define a closed path along which, cyclically, each slide performs its function.

According to an example not illustrated, the base B has a horizontal support surface having axially symmetrical arrangements with respect to the rotation axis of the main drum 4 for connecting the storage (s) 5 for both right-hand rotation (illustrated in FIG. 2) and left-hand rotation, wherein the position of the storage (s) 5, with reference to FIG. 2, would be at the rear of the main drum 4. For example, the arrangement comprises the provision of appropriate holes or studs already in place to mount and secure the storage 5 in the correct angular position, i.e. that corresponding to the raised position of the can.

The invention claimed is:

1. A machine assembly for applying a heat-sealable capsule to a container for a beverage, comprising:

a main drum (4) having a first plurality of sealing heads (7) and a second plurality of handling bases that are vertically movable by a first cam concentric with the main drum for bringing each container, during drum (4) rotation, from a lowered position for picking up the container and a raised position for sealing the capsule to a sealing position to the container with a corresponding sealing head (7); and a pick-up assembly (6) having a slide (13) driven along a closed trajectory synchronously with the main drum (4) and a pick-up and release capsule member (16) carried by the slide (13), wherein the pick-up assembly (6) comprises an angularly fixed crown to which stationary cam profiles are fixed, the stationary cam profiles including a second cam (C) that is horizontal and a third cam (15) that is vertical, wherein the slide (13) is configured to move vertically and horizontally with the pick-up and release member (16) using a horizontal slide (SO) guided by the second cam (C) defining at least one section wherein the pick-up and release capsule member (16) runs on a same circular arc trajectory as a gripping member (28) of the capsule carried by a corresponding sealing head (7), and a vertical slide (SV) guided by the third cam (15) defining, a raised section wherein the pick and release member (16) is vertically proximal to the gripping member (28) and, in use, releases the capsule to the corresponding sealing head (7), and a lowered section wherein, in use, the pick-up and release member (16) moves radially away from the gripping member (28) after releasing the capsule.

2. The machine assembly according to claim 1, wherein the third cam (15) surrounds the second cam (C).

3. The machine assembly according to claim 1, wherein the gripping member (28) is configured to have a substantially fixed vertical position when receiving the capsule from the pick-up and release member (16).

4. The machine assembly according to claim 1, further comprising an electronic control assembly connected to a motor (17) and programmed so that an angular picking up position of the capsule from a storage (5) is static and a transferring step of the capsule to the corresponding sealing head (7) is performed while the slide (13) is moving on said second and said third cams (C, 15).

5. The machine assembly according to claim 1, further comprising a mounting base (B) on which the main drum (4) and the pick-up assembly (6) are mounted, wherein the mounting base (B) is configured to provide at least a first and a second position arranged for mounting the pick-up assembly (6) in a manner dependent on whether the main drum (4) is left-handed or right-handed.

6. The machine assembly according to claim 1, further comprising:

at least one of a first conveyor (1) provided with a can spacer (2) or a second conveyor (10) provided with a pick-up drum assembly (9), wherein the at least one of the first or the second conveyor comprises a first and a second interface assembly to the main drum (4), and wherein both the first and the second interface assembly are configured such that a first trajectory of an axis of the container in movement aboard the first or the second conveyor (1, 10) is tangent to a second trajectory of the axis of the container aboard the main drum (4) at a point where the first and second trajectories meet.

7. A method of configuring a machine assembly according to claim 1, comprising:

providing the machine assembly according to claim 1;

driving, with a programmable motor (17), a rotation of the pick-up assembly (6) carrying the pick-up and release member (16) along a closed trajectory synchronised with a rotation of the main drum (4) having the plurality of sealing heads (7);

synchronizing the programmable motor (17) of the pick-up assembly (6) with an additional motor driving the main drum (4), so that during operation the pick-up and release member (16) and a corresponding gripping member (28) of a sealing head (7) move along corresponding circular-arc trajectories; and adjusting, through a control or user interface of the machine assembly, a lead or a delay of an angular position of the pick-up and release member (16) with respect to the gripping member (28), so that, when facing each other, the pick-up and release member (16) and the gripping member (28) present corresponding parallel and spaced axes for transferring the capsule.

8. A method of configuring a machine assembly according to claim 1, comprising the steps of:

providing the machine assembly according to claim 1, wherein the second cam (C) comprises a first lobe and a second lobe and further comprises a plurality of removable circumference sectors (S1, S2, S3, S4, S5, S6), and wherein at least one circumference sector is configured to be usable for both a right-hand rotation and a left-hand rotation of the main drum (4) by defining a raised or lowered position of a can;

mounting the at least one circumference sector (S1; S2) on the machine assembly; and mounting the other circumference sectors (S3, S4, S5, S6) for either left-hand or right hand rotation.

* * * * *